US006811861B2

(12) United States Patent
Bank et al.

(10) Patent No.: US 6,811,861 B2
(45) Date of Patent: Nov. 2, 2004

(54) STRUCTURAL REINFORCEMENT USING COMPOSITE STRIPS

(75) Inventors: Lawrence C. Bank, Madison, WI (US); Anthony J. Lamanna, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 69 days.

(21) Appl. No.: 09/995,158

(22) Filed: Nov. 27, 2001

(65) Prior Publication Data

US 2002/0110680 A1 Aug. 15, 2002

Related U.S. Application Data

(60) Provisional application No. 60/253,450, filed on Nov. 28, 2000.

(51) Int. Cl.[7] ..... B32B 27/12; B32B 5/12; B32B 9/00; B32B 9/04; E04C 3/30

(52) U.S. Cl. ..... 428/297.4; 428/107; 428/113; 428/114; 428/408; 428/441.1; 52/730.7

(58) Field of Search ..... 428/113, 114, 428/408, 107, 297.4; 411/411; 52/730.7

(56) References Cited

U.S. PATENT DOCUMENTS

| | | | | |
|---|---|---|---|---|
| 3,368,016 A | | 2/1968 | Birguer | |
| 3,495,494 A | * | 2/1970 | Scott | 411/411 |
| 4,265,981 A | * | 5/1981 | Campbell | 428/591 |
| 4,621,944 A | | 11/1986 | Jordense | |
| 4,786,341 A | | 11/1988 | Kobatake et al. | |
| 4,909,690 A | * | 3/1990 | Gapp et al. | 411/411 |
| 4,984,405 A | * | 1/1991 | Sauder | 52/404.5 |
| 5,043,033 A | | 8/1991 | Fyfe | |
| 5,127,783 A | * | 7/1992 | Moghe et al. | 411/411 |
| 5,313,749 A | | 5/1994 | Conner | |
| 5,362,545 A | | 11/1994 | Tingley | |
| 5,479,748 A | | 1/1996 | Siller | |
| 5,607,527 A | | 3/1997 | Isley, Jr. | |
| 5,637,375 A | * | 6/1997 | Hohman | 428/113 |
| 5,640,825 A | | 6/1997 | Ehsani et al. | |
| 5,648,138 A | | 7/1997 | Tingley | |
| 5,655,243 A | | 8/1997 | Kim | |
| 5,721,036 A | | 2/1998 | Tingley | |
| 5,725,929 A | | 3/1998 | Cooke et al. | |
| 5,749,674 A | | 5/1998 | Wilson, Sr. | |
| 5,867,855 A | | 2/1999 | Kim | |
| 5,894,003 A | | 4/1999 | Lockwood | |
| 5,910,352 A | | 6/1999 | Tingley | |
| 6,037,049 A | | 3/2000 | Tingley | |
| 6,045,310 A | * | 4/2000 | Miller et al. | 411/383 |
| 6,050,047 A | * | 4/2000 | Covelli et al. | 52/730.7 |
| 6,183,835 B1 | * | 2/2001 | Cho et al. | 428/113 |
| 6,612,085 B2 | | 9/2003 | Edwards et al. | |

OTHER PUBLICATIONS

Strongwell, Extren DWB® Design Guide, 2003.

Black, S., Contractors Take Composites To New Lengths, *Composites Technology*, Sep./Oct. 2000, vol. 6, No. 5, pp. 26–30.

(List continued on next page.)

*Primary Examiner*—Rena Dye
*Assistant Examiner*—Camie S Thompson
(74) *Attorney, Agent, or Firm*—Craig A. Fieschko, Esq.; DeWitt Ross & Stevens S.C.

(57) ABSTRACT

A composite structural reinforcing strip is affixed to a structure to be reinforced (such as a bridge span, foundation pillar, or similar structure) by the use of several fasteners which extend through the strip and into the structure. The reinforcing strip preferably includes elongated continuous parallel fibers which have lengths extending along the length of the strip, and nondirectional fibers distributed transversely across the strip, with a polymer matrix affixing the parallel and nondirectional fibers. The strip may be placed on the structure to be reinforced, and may be attached thereon by actuating a common powder-actuated fastener gun to send fasteners through the strip and into the structure.

29 Claims, 3 Drawing Sheets

OTHER PUBLICATIONS

Lamanna, A.J., Bank, L.C., and Scott, D.W., Flexural Strengthening of RC Beams using Fasteners and FRP Strips, ACI Structures Journal, 2001, vol. 98, No. 3, pp. 368–376.

Lamanna, A.J., Bank, L.C., and Scott, D.W., (2001), Rapid Strengthening of RC Beams using Powder Actuated Fasteners and FRP Strips, in Proceedings of the 5th International Symposium of FRP in Reinforced Concrete Structures, Cambridge, UK, Jul. 16–18, 2001, pp. 389–397.

Ray, J.C., Scott, D.W., Lamanna, A.J., and Bank, L.C., Flexural Behavior of Reinforced Concrete Members Strengthened using Mechanically Fastened Fiber Reinforced Polymer Plates, Proceedings of the US Army Science Conference, Baltimore, MD, Dec. 11–13, 2000.

Ray, J.C., Velazquez, G.I., Lamanna, A.J., and Bank, L.C., Rapidly Installed Fiber–Reinforced Polymer (FRP) Plates for Upgrade of Reinforced Concrete Bridges, in High Performance Materials in Bridges and Buildings, Koha, HI. Jun. 2001.

Master Builders Technologies, MBrace™ Composite Strengthening System, Apr. 1998, SAP# 114811, mbrace2.pm6.

Master Builders Technologies, MBrace™ Composite Strengthening System with carbon fiber reinforcement for Concrete Substrates, Nov. 1998, #115372 mspec398.doc.

Structural Preservation Systems, Inc., MBrace Composite Strengthening System, Nov. 18, 1999, http://www.spsrepair-.com/MBrace/mbrace_composite _strengthening_s.htm,.

Sika Corporation, Technology and Concepts for Sika® CarboDur® Structural Strengthening Systems, http://www.sika.com.

Sika Corporation, Sika CarboDur® Carbon fiber laminate for structural strengthening, Nov. 1998.

Sika Corporation, Sikadur® Hex 300/306 High–modulus, high strength, impregnating resin, May 1998.

Sika Corporation, Sikadur® 330 High–modulus, high-strength, impregnating resin, Aug. 1998.

Sika Corporation, Sikadur® 30, High–modulus, high-strength, structural, epoxy paste adhesive for use with Sika CarboDur® reinforcement, Apr. 1997.

Sika Corporation, SikaWrap® Hex 230C, Carbon fiber fabric for structural strengthening, Jul. 1999.

Sika Corporation, SikaWrap® Hex 113C, Bi–Directional Carbon fiber fabric for structural strengthening, Jul. 1999.

Sika Corporation, SikaWrap® Hex 107G, Glass fiber fabric for structural strengthening, Jun. 1999.

Sika Corporation, SikaWrap® Hex 106G, Bi–Directional Glass fiber fabric for structural strengthening, Jun. 1999.

Sika Corporation, SikaWrap® Hex 103C, Carbon fiber fabric for structural strengthening, Jun. 1999.

Sika Corporation, SikaWrap® Hex 100G Glass fiber fabric for structural strengthening, Jun. 1999.

Subedi, DR. N.K. and Baglin, P.S., "External plate reinforcement for strengthening concrete beams", Construction Repair, Nov./Dec. 1996, vol. 10, No. 6, pp. 24–29.

Subedi, DR. N.K. and Baglin, P.S., "External Plate Reinforcement For Concrete Beams", Journal of Structural Engineering, Dec. 1998, pp. 1490–1495.

Baglin, P.S. and Subedi, N.K., "The Behaviour of Mechanical Connectors for Retroplated Reinforced Concrete Beams", Research Report, Jun. 1999, Department of Civil Engineering, University of Dundee, Dundee, Scotland.

* cited by examiner

STRUCTURAL REINFORCEMENT USING COMPOSITE STRIPS

CROSS-REFERENCE TO RELATED APPLICATIONS

This application claims priority under 35 USC §119(e) to U.S. Provisional Patent Application No. 60/253,450 filed 28 Nov. 2000, the entirety of which is incorporated by reference herein.

STATEMENT REGARDING FEDERALLY SPONSORED RESEARCH

This invention was made with United States government support awarded by the following agencies:

U.S. Army Corps of Engineers Grant No(s).: DACA39-99-K-0001;

DACA42-00-P-0044; and DACA42-00-P-0364.

The United States has certain rights in this invention.

FIELD OF THE INVENTION

This disclosure concerns an invention relating generally to post-construction reinforcement of structures (such as buildings, bridges, dams, and the like), and more specifically to structural reinforcements externally affixed to preexisting structures.

BACKGROUND OF THE INVENTION

In recent years there has been an increase in the use of lightweight, nonmetallic, fiber reinforced composite materials to repair and strengthen concrete structures. A common repair method is to adhesively bond strips of thin composite laminates, also known as fiber reinforced polymer (FRP) strips, to the surfaces of reinforced concrete beams or slabs to increase their capacity. Typically these composite strips are attached to the undersides of the beams/slabs to increase the flexural capacity of the reinforced concrete element. The method used to strengthen concrete beams with composite strips is similar to one that has been used with some popularity since the mid-1970's, particularly in Europe, to repair concrete beams with steel plates. In one popular method, a composite strip manufactured by the Sika Corporation (Lyndhurst, N.J., USA) is bonded to the concrete surface with a room temperature curing two-part epoxy adhesive. This method is time-consuming since it can take days per application to sandblast, clean, and smooth the concrete so that it is suitable for bonding. Additionally, the two-part epoxy system must be mixed in a precisely controlled fashion and applied in a careful manner to produce a good bond line. Following the application of the adhesive, the composite strip must be left for at least a day, and often the adhesive will not reach design strength for approximately a week.

Other systems (e.g., one promoted by Master Builders Inc., Cleveland, Ohio USA) make use of preformed fiber fabrics and apply the epoxy resin system to the fabric and to the concrete substrate simultaneously. These systems require the same careful and time-consuming preparation and curing as in the case of bonding a prefabricated composite strip to the concrete.

In situations where it is necessary to make extremely rapid repairs to structures, e.g., where military operations require rapid repairs of bridges, or disaster relief efforts require that wall or ceiling beams be quickly reinforced, the foregoing adhesive bonding methods are clearly insufficient owing to the curing time needed for the adhesive. Thus, there is interest in developing mechanical attachments for reinforcing strips that would replace the time-consuming bonding methods. Prior methods of structural reinforcement use externally affixed "tendons", generally made of steel, which are bolted to the structure at their ends. These are generally unsuitable for rapid repairs owing to the time needed to suitably affix the tendons to the structure, and the size and weight of the tendons generates additional problems because they are difficult to transport and install by military and/or emergency personnel with minimal tools and manpower. The use of composite strips in place of metal tendons would ease transportability and weight concerns, but the use of mechanically attached composite strips has not been accepted because the stress concentration points created by the fasteners tends to greatly decrease the strength of the strips. The high loads at the fastener holes in the strips cause ripping, which propagates through the strips until failure occurs. Thus, mechanical attachment of composite strips has thus far been primarily limited to the use of anchorages (e.g., anchor bolts or cover plates) at the ends of adhered composite strips, not to serve as the primary load transfer mechanism between the concrete and the composite strip, but to prevent catastrophic brittle failure of adhered strips when the adhesive bond separates from the underlying structure. Similar mechanical anchorages have been used with epoxy-bonded steel plates to prevent failure from the plates peeling from the concrete.

SUMMARY OF THE INVENTION

The invention, which is defined by the claims set forth at the end of this document, is directed to methods and apparata which at least partially alleviate the aforementioned problems. A basic understanding of some of the preferred features of the invention can be attained from a review of the following brief summary of the invention, with more details being provided elsewhere in this document.

Preferred versions of the invention involve a structural reinforcing strip which is affixed to a structure to be reinforced by the use of several fasteners which extend through the strip and into the structure. The reinforcing strip preferably includes elongated continuous parallel fibers which have lengths extending along the length of the strip, and nondirectional fibers distributed transversely across the strip, with a polymer matrix affixing the parallel and nondirectional fibers. The parallel fibers are preferably provided in multi-fiber bundles (e.g., rovings or tows) which are discretely spaced transversely across the strip. The nondirectional fibers, which may be defined by a nonwoven mat provided within the polymer matrix, are preferably distributed at least substantially uniformly across the strip. The strip may be dimensioned so that it can be coiled into a roll for easy transport, and it may then be uncoiled and cut to length at the site at which it is to be used. The cut strip may then be placed on the structure to be reinforced, and may be attached thereon by actuating a common powder-actuated fastener gun to send fasteners through the strip and into the structure. If desired, pilot holes for the fasteners may be pre-drilled into the structure prior to insertion of the fasteners through the strip and structure to diminish potential damage to the underlying structure (e.g. spalling where the structure is made of concrete, or cracking where the structure is made of wood or other materials). Additionally, compressible cushions (such as rubber/neoprene washers) may be provided between the fasteners and the strips prior to inserting the fastener through the strip, so that the fastener heads (assuming they are present) will bear against the cushion, rather than directly against the strip. Adhesive may also be applied between the strip and the surface of the structure prior to attaching the strip thereon.

A strip as previously described, being affixed to a structure in the foregoing fashion, is believed to provide several advantages that were not previously fully realized in prior structural reinforcement methods and apparata.

Initially, the invention is well suited for use in rapid structural repairs because the strips (or coiled strips) are easily carried by a single person, easily cut by battery-operated tools suitable for field use, and easily affixed to structures by use of portable fastener guns which allow fastening without the need for pre-forming holes in the strips. The invention is therefore particularly useful in field conditions wherein manpower, power supplies, lifting equipment, and other resources are scarce or difficult to access. Since the strips may be installed by a single person with no or minimal prior training, the invention is extremely useful in cases of disaster, where emergency personnel may need to rapidly perform unfamiliar structural reinforcement tasks without education or supervision. Since no time-consuming adhesive curing is required, the invention is readily usable upon installation, which further enhances its utility where time is short.

Further, the strips are believed to provide superior strength per unit size and weight owing to their unique structure, which is particularly suited for usage with fasteners. Ordinarily, the stress concentrations caused by the use of fasteners with composite reinforcing strips results in splitting failure of the strips. Such failure may be exacerbated where fasteners are driven into strips wherein fibers are oriented in predetermined directions, since the fastener driving force, or the bearing stress exerted by the fastener on the strip, may cause fractures to occur along planes parallel to the fibers (regardless of whether they are parallel to the axes of the strips or at other orientations, and whether the fibers are unidirectional or multidirectional). By using non-directional fibers, no well-defined fracture planes are provided, and strip fractures are less likely to form and propagate upon insertion of the fastener. The inclusion of fibers oriented parallel with the lengths of the strips then increases the load-bearing capacity of the strips, particularly since the fastener loading on the nondirectional fibers is transmitted to the parallel fibers. Additionally, the nondirectional fibers transmit the fastener loads to the parallel fibers, and thereby distribute forces over a larger area for greater strength Testing has demonstrated that when structures reinforced with the strips fail, unless catastrophic failure first occurs in the underlying structure (e.g., the position of the structure underlying the fasteners breaks away), the strips impart greater ductility to the structure and allow greater deflection prior to ultimate failure. This provides more time for warning and implementation of additional reinforcement measures, and is thereby much safer than the catastrophic failure experienced with many prior reinforcing strips.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
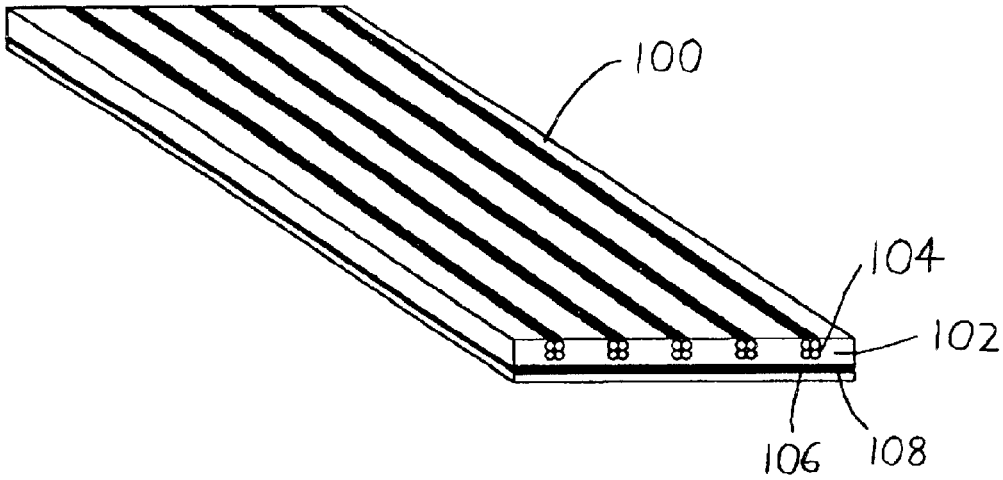
FIG. 1 is a perspective view of a section of an exemplary reinforcing strip.
Figure 2:
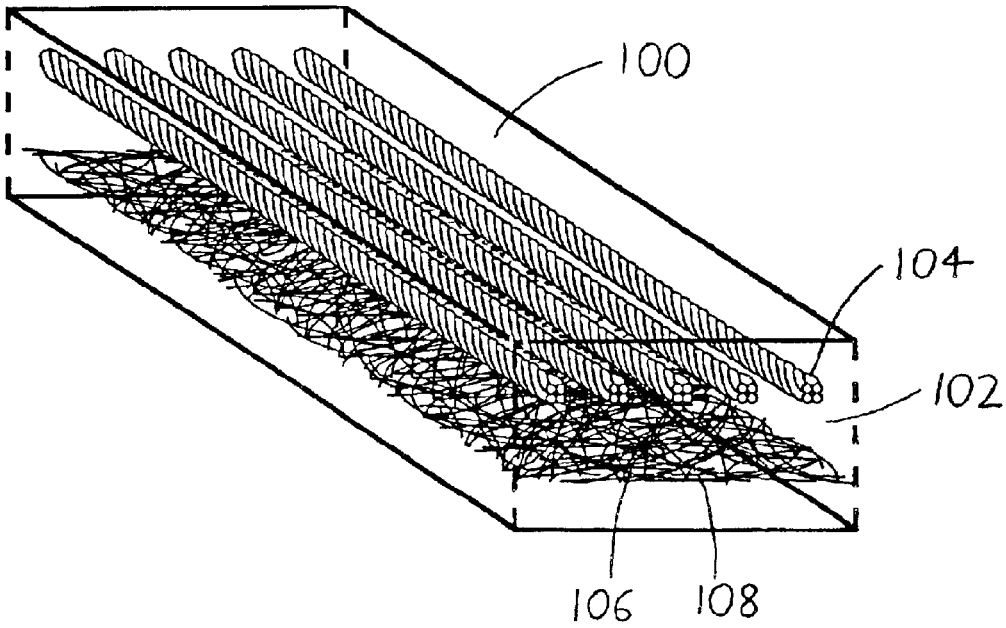
FIG. 2 is an exploded view of the reinforcing strip of FIG. 1.

Referring to FIGS. 1 and 2, an exemplary preferred composite reinforcing strip 100 is illustrated. The strip 100, which is preferably continuously formed via pultrusion, includes a polymer matrix 102 having embedded fibers of two types. Initially, elongated continuous strand fibers 104, which are fed from reels during the pultrusion process, are provided with their lengths extending along the length of the strip 100, with the fibers 104 being transversely arrayed with their axes parallel to each other and to the axis of the strip 100. While the fibers 104 could be closely arrayed side by side with small spacings between the fibers 104 (e.g., with fiber spacings being some distance between 0–5× the fiber diameters), they are preferably provided with discrete spacings which are sufficiently large that a fastener (as discussed later in this document) can be accommodated between adjacent fibers if desired. More preferably, the fibers 104 are provided in bundles or rovings of multiple fibers as illustrated in FIGS. 1 and 2 (e.g., in rovings of 2000–5000 fibers wherein each fiber has a diameter of 10–20 micrometers), with the bundles/rovings being spaced in the foregoing manner. The parallel fibers 104 are preferably formed of materials having high stiffness, such as carbon, glass, or aramid (KEVLAR). Additionally, they may be colored so that they visibly contrast with the matrix 102 of the strip 100, and may be embedded within the matrix 102 of the strip 100 at a distance such that they are visible from the surface of the strip 100 (as particularly seen in FIG. 1), for reasons that will be discussed at greater length later in this document.

Nondirectional fibers 106, i.e., fibers which are not oriented in any predetermined directions, are then distributed transversely across the strip 100. These nondirectional fibers 106 are preferably continuous, or at least have a strand length sufficient that at least some of the nondirectional fibers 106 may extend between adjacently-spaced parallel fibers 104 to better transmit loads to the parallel fibers 104. However, nondirectional fibers 106 of shorter length (such as chopped fibers) are also possible. Additionally, the nondirectional fibers 106 are preferably provided in mat form (as best seen in FIG. 2 at 108), with the mat 108 being continuously fed along with the parallel fibers 104 into the pultrusion die during manufacture of the strip 100. As with the parallel fibers 104, the nondirectional fibers 106 are preferably made of a strong and stiff material such as carbon, glass, or aramid. Glass is particularly preferred; while not as stiff as carbon, it is approximately as strong, and is (at the time this document was prepared) much less expensive.

The matrix 102 is preferably formed of a phenolic or vinylester resin, though other materials (e.g., polyester resins or epoxies) could be used instead. Depending on the manufacturing process used to form the strips 100, a thermoplastic matrix 102 may be feasible in lieu of a thermosetting matrix 102. A fiber-to-matrix volume ratio of at least 50% is preferred. The nondirectional fibers 106 preferably constitute less than half of the fiber content by volume, and most preferably they only constitute 5–20% of the fiber content by volume.

Figure 3:
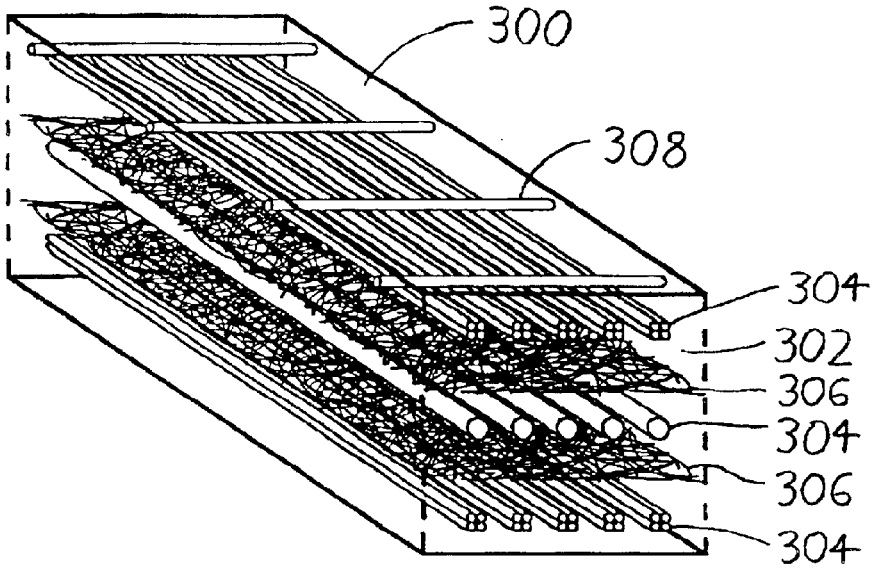
FIG. 3 is an exploded perspective view of a section of a second exemplary reinforcing strip.

The strip 100 may additionally include other fibers in addition to the aforementioned parallel fibers 104 and nondirectional fibers 106, though such additional fibers are not necessary to provide the strip 100 with the properties needed to enable fastener attachment of the strip 100 to structures requiring reinforcement. In particular, it is useful to provide fibers which are situated within the matrix 102 at regular predetermined distances, and which are suitably colored, to allow them to visibly stand out on the surface of the strip 100. For example, "tracer" fibers with colors in contrast with the matrix 102 may be situated parallel to each other and perpendicular (or parallel) to the length of the strip 100 at one-inch intervals. The contrasting fibers allow users to more easily measure the strips 100 for cutting, and to more easily situate fasteners at desired distance intervals along the strip 100. An exemplary arrangement of this nature is shown in FIG. 3, wherein a second exemplary strip 300 having matrix 302, parallel fibers 304, and nondirectional fibers 306 has its parallel fibers 304 spaced at desired intervals for marking purposes, as well as including parallel fibers 308 provided for similar purposes. The contrasting tracer fibers may be provided by the parallel fibers 304; may be provided by other fibers provided in addition to the parallel fibers 304; or may be provided in addition to the nondirectional fibers 306 (e.g., where the nondirectional fibers 306 are provided in mat form, the mat may include tracer fibers therein). It may sometimes be desirable for the matrix 302 to have a color matching or approximating that of the structure to which the strip 300 is to be attached, e.g., a gray matrix 302 may be used where its strip 300 is to be affixed to concrete, to better enhance the aesthetic appearance of the structures to which the strips 300 are applied.

Figure 4:
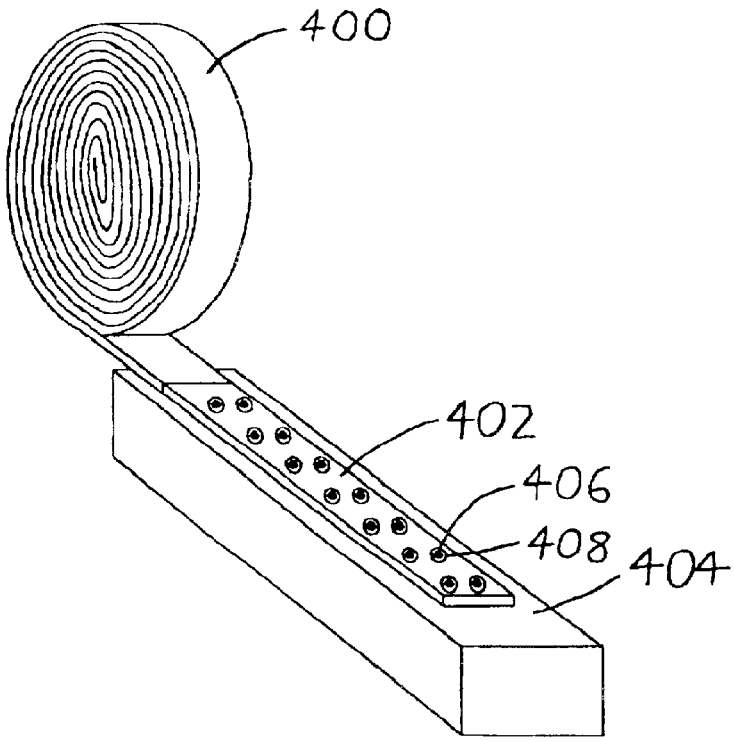
FIG. 4 is a perspective view of an exemplary reinforcing strip (such as that of FIGS. 1–3) being unrolled from a coil for cutting and attachment to a structure to be reinforced.

When the parallel fibers 104 and nondirectional fibers 106 are adhered in a matrix 102 using an appropriate pultrusion or other process, using a die or mold having the appropriate dimensions, the strip can be formed in a very long and continuous length suitable for rolling into a coil (as exemplified by the coil 400 in FIG. 4). When a structure requires repairs, the coil 400—which may be sufficiently small and lightweight to be carried by a single person—may be carried to the site of the structure 404. A sufficient length of strip 402 may be unrolled and cut from the coil 400 by any suitable tool. Beneficially, when the strip 400 is formed from the foregoing materials, it is sufficiently soft that it may be cut by battery-powered handsaws or similar portable cutting tools, which further enhances the portable use of the coil 400 and strips 402. The cut strip 402 may then be affixed to the surface of the structure 404 by adhesives, fasteners, or other processes, with a particularly preferred attachment process being as follows.

Rather than use time-consuming adhesives, anchor plates, or bolts, the preferred method of attaching the strip to the structure is via powder-actuated fasteners. Such fasteners use drivers ("guns") to detonate explosive charges to drive fasteners into structures, with the charge and fastener sometimes being combined in a bullet-like structure. Powder-actuated fastener guns are often used in the construction industry to affix finishing materials to concrete or steel, e.g., when installing electrical conduit on concrete walls or attaching wooden furring strips to steel beams, but they are generally not used in structural applications. Referring again to FIG. 4, to affix the strip 402 to the structure 404, all the user need do is place the strip 402 on the surface of the structure 404 to be reinforced, situate the head of the fastener gun against the strip 402, and activate the gun to cause a fastener 406 to penetrate the strip 402 and the underlying structure 404, with the head of the fastener 406 situated against the surface of the strip 402 and the major portion of its body being embedded within the structure 404. While straightforward application of the fasteners 406 in this manner provides acceptable results, it may in some cases be useful to take additional measures.

First, it is beneficial to insert a compressible member, e.g., an elastomeric pad or washer (as illustrated by washers 408 in FIG. 4), between the head of the fastener gun and the strip 402 prior to firing the fasteners 406. This will help to prevent bearing damage from the fastener heads driving into the strips 402, and instead the clamping force from the fastener heads will be distributed over the compressible member 408, better enhancing the engagement between the fastener 406 and strip 402 and increasing the bearing strength of the strip 402.

Second, it may in some cases be useful to predrill holes in the structure 404 to which the strip 402 is to be fastened, particularly if the structure is extremely stiff and/or if the fastener 406 is to enter the structure 404 near its edge. Powder actuated fasteners compress the structure 404 wherein they are inserted since the fastener 406 displaces the structure's material during entry. If the fastener 406 is inserted near the edge of the structure 404, such material displacement may cause cracking of the structure 404. Additionally, if the material of the structure 404 is too stiff, the structure 404 may simply shatter beneath the fastener 406 without the fastener 406 engaging the structure 404. The drilling of pilot holes helps avoid these problems, but pilot holes are generally not necessary unless high-strength (and high stiffness) concrete is used, since such concrete is more prone to shattering.

It is also preferred that the strip 402 be affixed to the structure 404 by multiple fasteners 406 distributed over its length and width, or at least multiple fasteners 406 distributed about the ends of the strip 402. This more evenly distributes stresses across the strip 402 and the underlying structure 404, and helps to prevent local failure from causing overall failure of the strip 402/structure 404 combination.

Test Results

Reinforcing strips as previously described were tested on steel-reinforced concrete beams to determine their degree of reinforcement. Five beams were tested, with two beams (beams 1 and 2) being tested without the use of reinforcement strips (or other reinforcements) to serve as control beams; one beam (beam 3) being tested with the reinforcing strip being bonded to the beam with adhesive alone; and two beams (beams 4 and 5) being tested with reinforcement strips attached by fasteners alone, and with different fastener placement arrangements.

Figure 5:
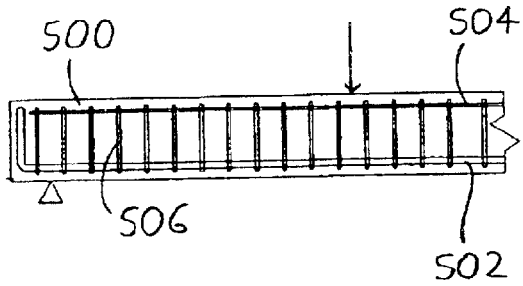
FIG. 5 is a side elevated sectional view of a reinforced concrete beam tested with the present invention (the test results being presented elsewhere in this document).
Figure 6:
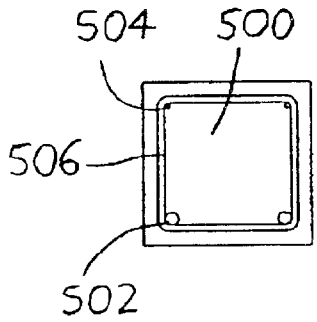
FIG. 6 is an end elevated sectional view of the reinforced concrete beam of FIG. 5.

The steel-reinforced concrete beams were designed in accordance with American Concrete Institute standard ACI 318-99, and are illustrated in FIGS. 5 and 6. These beams 500 measured 3658 mm (144 in.) long with a cross section (shown in FIG. 6) of 305 mm by 305 mm (12 in. by 12 in.). Primary tension reinforcement was provided by two #8 Grade 60 deformed steel bars 502. Two #3 Grade 60 deformed steel top bars 504 were used in order to provide stability of the rebar cage during casting. Shear reinforcement was provided in the form of closed stirrups of #4 grade 60 deformed steel bars 506. These stirrups 506 were placed at 102 mm (4 in.) on center throughout the shear span of the beam 500 and into one-third of the moment span. Spacing of the stirrups 506 was increased to 127 mm (5 in.) and then 152 mm (6 in.) in the center of the moment span. This stirrup spacing ensured that a shear failure in the strengthened beams 500 would be avoided. The beams 500 were cast at the U.S. Army Engineering Research and Development Center (Vicksburg, Miss., USA) with concrete supplied by a local vendor. A pea gravel mix was used to facilitate casting. The measured concrete strength at 28 days was 32.7 MPa (4740 psi).

For beams 4 and 5, FRP composite material reinforcing strips containing parallel carbon fibers and nondirectional glass fibers in a vinylester resin were pultruded by Strongwell (Chatfield Division, Chatfield, Minn. USA). The reinforcing strips had a cross section of 102 mm wide by 3.175 mm thick (4 in. by 0.125 in.) and were 3048 mm (120 in) long. The target design modulus was 55.2 GPa (8,000 ksi). The reinforcing strips were tested according to ASTM D3039, and the modulus and tensile strength were determined to be 59.4±2.8 GPa (8,610±400 ksi) and 862±28 MPa (125±4.0 ksi) based on ten tests.

For beams 4 and 5, fasteners were applied using a Hilti DX A41 Powder Actuated Fastening System (Hilti Inc., Tulsa, Okla. USA). The DX A41 system uses a 6.8 mm (0.27 in.) caliber short gunpowder booster. Purple boosters, signifying extra heavy charge, were used in conjunction with Hilti X-AL-H fasteners for attaching each strip. The X-AL-H fasteners are made of specially heat-treated high-strength steel that is zinc plated to resist corrosion. The specific fasteners used were X-AL-H47 fasteners, which were 47 mm (1.875 in.) long with a shank diameter of 4.5 mm (0.177 in.). Pre-drilling of holes to receive fasteners was done with a DX-Kwik bit, which had a diameter of 4.76 mm (0.188 in) and a drill bit length of 15.88 mm (0.625 in.). A standard hammer drill was used with this bit.

As previously noted, beams 1 and 2 were tested without strengthening so that they would serve as control beams. Beam 3, using a bonded/adhered strip without fasteners, was prepared by sandblasting the bottom surface of the beam and then flushing it with water. The reinforcing strip was sanded with 400 grit sandpaper, then cleaned with acetone. After the beam was allowed to dry out, Sikadur Hex 300 (Sika Corporation, Lyndhurst, N.J., USA) two-part epoxy resin was thickened with fumed silica and applied to the sandblasted surface and to the reinforcing strip. The strip was then aligned and placed on the beam, and 7.3 N/cm (50 lb/ft) of weights were applied to the strip. The beam was covered in black plastic and left to cure in the sun for five days before testing.

For beams 4 and 5, the reinforced concrete beam 500 was turned over so that the tensile steel 502 was on the top. In beam 4, the reinforcing strip was attached using two rows of fasteners that were 51 mm (2 in.) apart, and a spacing of 51 mm (2 in.) along the length of the beam. Attachment for beam 5 used two rows of fasteners 51 mm (2 in.) apart with a spacing of 76 mm (3 in.) along the length of the beam. The fastener locations were marked on each reinforcing strip, and the reinforcing strips were centered with the concrete beams from side to side and end to end. The strips were held in place by a technician at both ends. At the centers of the beams, two shallow pilot holes were drilled in a line perpendicular to the length of the beam. These holes were drilled through the reinforcing strip so that they extended approximately 12.7 mm (0.5 in.) into the concrete. The two holes were drilled in approximately ten seconds. The fasteners were then inserted into the Hilti DX A41 tool, lined up with the holes, and driven into the concrete. Very little spalling was observed, and the complete attachment of each reinforcing strip took about approximately 30 minutes. The beam was then turned back over, so that the tensile steel was on the bottom, taking care not to damage the attached strip or fasteners, and placed on the testing supports.

The beams were then supported near their ends and loaded near their centers by a hydraulic actuator. Each beam was tested on a 3353 mm (132 in.) total span, with each shear span and the moment span being 1118 mm (44 in.). In beams 4 and 5, the reinforcing strips terminated 152 mm (6 in.) from the supports. A lightweight aluminum frame was attached to each beam at half of the beam depth at the supports. Small plexiglass blocks were attached to the sides of each beam at half of the beam depth at the midspan with a two-part epoxy. Two LVDTs were attached to each aluminum frame to read the deflection of the beam on both sides. Strain gages were attached to the composite strip at midspan. An MTS Testar system (MTS Systems Corporation, Eden Prairie, Minn., USA) was used to control the 490 kN (110 kip) hydraulic actuator. An Optim Megadac (Optim Electronics Corporation, Germantown, Md. USA) was used for data collection. The beams were placed directly on the supports, and thin wood strips, similar to those used in split tensile tests, were placed under the load points. The beams were loaded at the rate of 1.3 mm/min (0.05 in./min) to an actuator displacement of 25 mm (1 in.), and then at a rate of 2.5 mm/mm (0.1 in./min) to failure.

Figure 7:
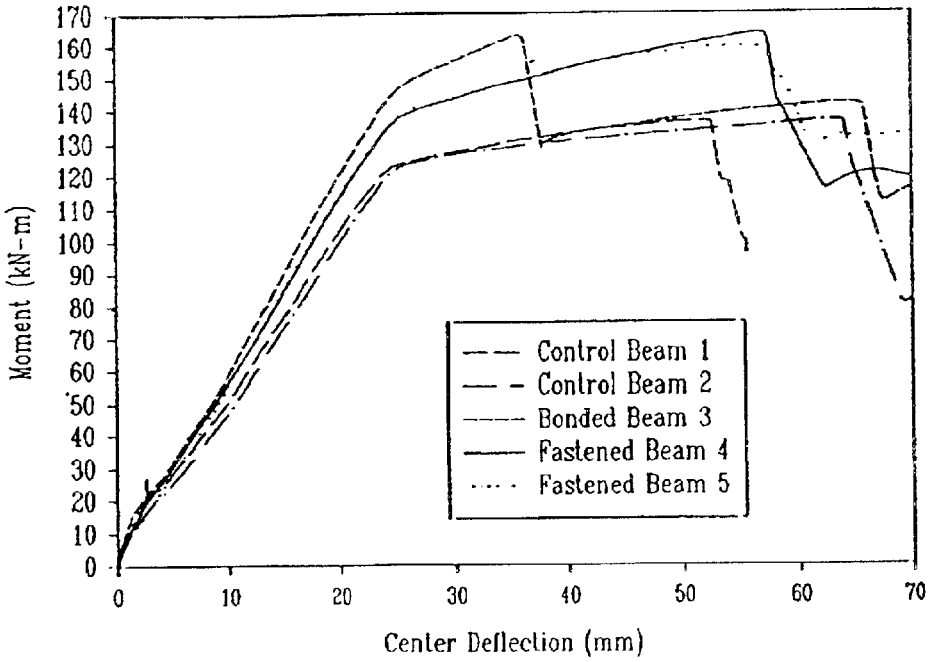
FIG. 7 is a moment-deflection chart illustrating experimental results for the concrete beams of FIGS. 5–6 with and without reinforcing strips attached.

Test results are then illustrated in FIG. 7, wherein moment-deflection curves for each beam are illustrated. Control beams 1 and 2 illustrate conventional reinforced-beam loading behavior, with roughly linear elastic behavior occurring up to a first yield point at which the concrete begins to fail, and then a subsequent roughly linear post-yield moment-deflection curve wherein the behavior of the metal reinforcements is dominant. Beams 1 and 2 had yield moments of 122.3 kN-m (1082 k-in) and ultimate moments of 136.4 kN-m (1207 k-in). Beam 1 failed at a midspan deflection of about 53 mm (2.1 in.) while beam 2 failed at a deflection of 64mm (2.5 in.), making the average failure deflection 58 mm (2.3 in.).

Beam 3 yielded at 148.0 kN-m (1310 k-in), a 21% increase over the yield moment of the control beams. This beam showed an increased stiffness (less deflection per unit load) in the elastic range as compared to the control beams, and a secondary post-yield stiffness before the adhesive layer suddenly failed, at which point the beam's curve falls to track those of control beams 1 and 2 for a short period of deflection prior to ultimate failure. Concrete failure occurred at an ultimate moment of 163.1 kN-m (1444 k-in), a 20% increase over the control beams. It is important to note that the beam failed at a midspan deflection of 36 mm (1.4 in.), showing much less ductility, or deflection capacity, than the control beams. A comparison of the curves for beam 3 versus beams 1 and 2 illustrates the known advantage of bonded-strip beams to have increased strength compared to unreinforced beams, but also illustrates the disadvantageous lack of ductility that the bonded strips provide.

Beams 4 and 5 both yielded at 139.1 kN-m (1231 k-in), a 14% increase over the control beams. They showed an increased stiffness (less deflection per unit load) in the elastic range greater than control beams 1 and 2, but less than that of beam 3, which is characteristic of slip between the strip and the concrete surface. Beams 4 and 5 also show a post-yield stiffness greater than the control beams, but less than that of beam 3. This is probably due to slip between the reinforcing strips and the concrete surface, caused by a combination of microcracking in the concrete substrate and initiation of bearing failure in the FRP strengthening strip around the fasteners. The beams had identical moment-deflection behavior up until within 3% of failure, with the ultimate moments of beams 4 and 5 being 163.8 kN-m (1450 k-in) and 159.4 kN-m (1411 k-in), increases of 20% and 17% over the control beams. These beams failed at a midspan deflection of 58 mm (2.3 in.), the average failure deflection of the two control beams. In beams 4 and 5 the concrete reached compression failure in the moment span while the reinforcing strips were still attached, resulting in the same amount of strengthening as the bonded beam 3, at a much greater ductility. The strips were difficult to remove with a crowbar after the test. The failure occurred in the mechanical connection between the reinforcing strip and the concrete surface, with the concrete beneath the fasteners breaking away and eliminating the fasteners' hold. The connections between the fasteners and their strips were maintained, with the strip yielding at certain fastener holes so that these fastener holes became elongated slots (wherein the fasteners were still maintained). Thus, the strip was allowed to slip with respect to the beams, but still maintained its load-bearing capacity. The strips and multiple fasteners thus impart their structures with a pseudo elasto-plastic load carrying mechanism, effectively enhancing the ductility of the structure and greatly diminishing the possibility of catastrophic failure.

TABLE 1 then summarizes the stress and strain in the reinforced strips of beams 4 and 5. The midspan reinforcing strip strain was measured using three strain gages and taking the average value. The stress in each strip was then calculated using the strip modulus and measured strain. The load in the strip in the center of the span was calculated using the strip area. The number of fasteners and number of fasteners per shear span are also given in TABLE 1. Given the close spacing of the fasteners, it is appropriate to make the assumption that the load is equally distributed over all fasteners in the shear span. Thus, the load per fastener can be calculated by dividing the load by the number of fasteners in the shear span. The load per fastener for beam 4, with a 2 inch spacing was 3703 N (834 lbs) and the load per fastener for beam 5, with a 3 inch fastener spacing, was 4830 (1097 lbs). The fasteners in beam 5 were at a load level above the 4448 N (1000 lb) maximum design capacity of the fasteners determined by prior testing of fastened connections performed at the University of Wisconsin-Madison. This could explain the loss of strengthening at very high load levels close to failure.

TABLE 1

| Beam | Midspan Strip Strain $\mu\epsilon$ | Midspan Strip Stress MPA (ksi) | Midspan Strip Load kN (kips) | No. of Fasteners | No. of Fasteners per Shear Span | Load per Fastener N (lb) |
|---|---|---|---|---|---|---|
| 4 | 7,740 | 459.8 (66.7) | 459.8 (25.4) | 124 | 40 | 3,707 (834) |
| 5 | 7,129 | 423.4 (61.4) | 423.4 (30.7) | 84 | 28 | 4,830 (1097) |

The test results illustrate that mechanical attachment of reinforcing strips to structures results in strength approximately equal to that of structures strengthened by bonding of reinforcing strips. Further, the use of fasteners provides the benefit of added ductility (deflection capacity) as compared to bonded strips. These features take on added importance when it is considered that they are achieved without the need for time-consuming adhesive bonding steps, making the invention particularly attractive for use when rapid structural repairs are required.

Other tests were performed to determine whether the pre-drilling of pilot holes for fasteners had a significant impact on reinforcement quality. It was found that capacity per fastened connection was approximately 2224 N (500 lb.) per fastener, about half of the capacity where a pre-drilled hole is used. Where holes were not pre-drilled, cratering sometimes occurred in the concrete owing to fastener entry, and the resulting damage sometimes resulted in fastener failures at very low loads. There was very wide scatter in the test results, indicating that some fasteners will adequately hold without pre-drilling while others will experience early failure. These results indicate that use of the invention without pre-drilling may still offer rapid installation and ductility benefits, but not as great as those benefits afforded where pre-drilling is used.

It is understood that various preferred versions of the invention are shown and described above to illustrate different possible features of the invention and the varying ways in which these features may be combined. Apart from combining the different features of the foregoing version in varying ways, other modifications are also considered to be within the scope of the invention. Following is an exemplary list of such modifications.

First, while the foregoing discussion concentrated primarily on use of the invention with concrete structures (particularly reinforced concrete structures), the invention is not limited to use with concrete structures. The invention is expected to have valuable use with wooden structures (e.g., to reinforce ceiling/floor beams in older buildings), as well as in metal structures.

Second, while the invention does not require adhesive bonding of the reinforcing strips to the underlying structure, adhesive may be accommodated along with mechanical attachment via fasteners. In some cases where only a single person is applying the reinforcing strips to a structure, the application of adhesive may be useful to allow the reinforcing strip to stick to a non-horizontal surface so that the technician has hand free to apply fasteners to the strip, at which point the strip will be fastened in place while the adhesive cures. Application of adhesive prior to insertion of fasteners may help to prevent the structure from cratering beneath the fasteners.

The invention is not intended to be limited to the preferred versions described above, but rather is intended to be limited only by the claims set out below. Thus, the invention encompasses all alternate versions that fall literally or equivalently within the scope of these claims.

What is claimed is:

1. A reinforced structure having:

a. an elongated structural reinforcing strip comprising:

(1) elongated continuous parallel fibers having lengths extending along the length of the strip;

(2) nondirectional fibers distributed transversely across the strip; and (3) a polymer matrix affixing and embedding the parallel and nondirectional fibers;

b. a structure to which the strip is affixed by several fasteners inserted through the strip and into the structure.

2. The reinforced structure of claim 1 wherein at least same of the parallel fibers are transversely arrayed across the strip with discrete spaces therebetween, and wherein the discrete spaces are at least sufficiently large to accommodate one of the fasteners therein.

3. The reinforced structure of claim 1 wherein the nondirectional fibers are distributed at least substantially across the strip.

4. The reinforced structure of claim 1 wherein the nondirectional fibers define a nonwoven mat.

5. The reinforced structure of claim 1 wherein the nondirectional fibers are continuous fibers.

6. The reinforced structure of claim 1 wherein the strip is sufficiently flexible that it may be coiled into a roll.

7. The reinforced structure of claim 1 wherein the parallel fibers are provided in bundles discretely spaced transversely across the strip.

8. The reinforced structure of claim 7 wherein the bundles are at least substantially evenly spaced transversely across the strip.

9. The reinforced structure of claim 7 wherein the nondirectional fibers define a nonwoven mat.

10. The reinforced structure of claim 9 wherein the nondirectional fibers are distributed at least substantially uniformly across the strip.

11. The reinforced structure of claim 1 wherein:

a. the polymer matrix is chosen from at least one of phenolic resin, vinylester resin, polyester resin, and epoxy; and b. the fibers are chosen from at least one of carbon fibers, glass fibers, and aramid fibers.

12. The reinforced structure of claim 1 wherein:

a. the parallel fibers include carbon fibers; and b. the nondirectional fibers include glass fibers.

13. The reinforced structure of claim 1 wherein the strip includes at least 50% fiber by volume.

14. A reinforced structure comprising:

a. an elongated strip having a polymer matrix with embedded fibers, the fibers including:

i. elongated continuous fibers having parallel lengths extending along the length of the strip, and ii. nondirectional fibers; and b. a series of fasteners extending through the strip and into the surface of the structure.

15. The reinforced structure of claim 14 wherein at least some of the nondirectional fibers have lengths greater than or equal to a distance defined between adjacent parallel continuous fibers.

16. The reinforced structure of claim 1 wherein at least some of the fasteners are spaced along the length of the strip.

17. The reinforced structure of claim 14 wherein at least some of the fasteners are spaced along the length of the strip.

18. The reinforced structure of claim 14 wherein at least some of the continuous fibers are transversely arrayed across the strip with discrete spaces therebetween, and wherein the discrete spaces are at least sufficiently large to accommodate one of the fasteners therein.

19. The reinforced structure of claim 14 wherein the nondirectional fibers are distributed at least substantially uniformly across the strip.

20. The reinforced structure of claim 14 wherein the nondirectional fibers define a nonwoven mat.

21. The reinforced structure of claim 14 wherein the nondirectional fibers are continuous fibers.

22. The reinforced structure of claim 14 wherein the strip is sufficiently flexible that it may be coiled into a roll.

23. The reinforced structure of claim 14 wherein the parallel fibers are provided in bundles discretely spaced transversely across the strip.

24. The reinforced structure of claim 23 wherein the bundles are at least substantially evenly spaced transversely across the strip.

25. The reinforced structure of claim 23 wherein the nondirectional fibers define a nonwoven mat.

26. The reinforced structure of claim 25 wherein the nondirectional fibers are distributed at least substantially uniformly across the strip.

27. The reinforced structure of claim 14 wherein:

a. the polymer matrix is chosen from at least one of phenolic resin, vinylester resin, polyester resin, and epoxy; and b. the fibers are chosen from at least one of carbon fibers, glass fibers, and aramid fibers.

28. The reinforced structure of claim 14 wherein:

a. the parallel fibers include carbon fibers; and b. the nondirectional fibers include glass fibers.

29. The reinforced structure of claim 14 wherein the strip includes at least 50% fiber by volume.

* * * * *